US008656627B2

(12) United States Patent
Howe et al.

(10) Patent No.: US 8,656,627 B2
(45) **Date of Patent: *Feb. 25, 2014**

(54) FOLDABLY SEGMENTED WEAPON SIGHT SYSTEM

(71) Applicant: North Pass, Ltd., Fort Collins, CO (US)

(72) Inventors: Phillip D. Howe, Fort Collins, CO (US); Richard A. Moore, Fort Collins, CO (US); Richard K. Herndon, Fort Collins, CO (US)

(73) Assignee: North Pass, Ltd., Fort Collins, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/892,189

(22) Filed: May 10, 2013

(65) Prior Publication Data

US 2013/0276346 A1 Oct. 24, 2013

Related U.S. Application Data

(63) Continuation of application No. 13/134,524, filed on Jun. 8, 2011, now Pat. No. 8,438,775.

(51) Int. Cl.
*F41G 1/16* (2006.01)
*F41G 1/02* (2006.01)

(52) U.S. Cl.
USPC ..... 42/112; 42/111

(58) Field of Classification Search
USPC ..... 42/111, 112
See application file for complete search history.

(56) References Cited

U.S. PATENT DOCUMENTS

| | | | | |
|---|---|---|---|---|
| 1,501,446 | A | 7/1924 | French | |
| 2,310,929 | A | 2/1943 | Beresky | |
| 2,819,528 | A | 1/1958 | Dahlberg | |
| 2,939,217 | A | 6/1960 | Hajek | |
| 3,969,827 | A | 7/1976 | Ellis | |
| 4,461,087 | A | 7/1984 | Norman | |
| 4,597,211 | A | 7/1986 | Miles | |
| 4,937,944 | A | 7/1990 | Montalvo | |
| 4,993,158 | A | 2/1991 | Santiago | |
| 5,659,965 | A | 8/1997 | Thibodeau et al. | |
| 6,487,809 | B1 | 12/2002 | Gaber | |
| 6,678,987 | B2 | 1/2004 | Howe | |
| 6,684,551 | B2 | 2/2004 | Howe | |
| 6,722,075 | B1 | 4/2004 | Gabaldon | |
| 6,779,290 | B1 | 8/2004 | Houtsma | |
| 6,860,056 | B2 | 3/2005 | Howe | |
| 7,434,344 | B2 | 10/2008 | Golan | |
| 7,908,783 | B2 | 3/2011 | Howe et al. | |
| 8,196,328 | B2 | 6/2012 | Simpkins | |
| 2003/0121196 | A1* | 7/2003 | Howe | 42/132 |
| 2003/0121197 | A1* | 7/2003 | Howe | 42/132 |
| 2004/0025398 | A1* | 2/2004 | Howe | 42/132 |
| 2004/0144010 | A1* | 7/2004 | Golan | 42/72 |
| 2011/0072705 | A1* | 3/2011 | Simpkins | 42/59 |
| 2012/0132068 | A1 | 5/2012 | Kucynko | |
| 2012/0311912 | A1 | 12/2012 | Howe et al. | |

* cited by examiner

*Primary Examiner* — Michael David
(74) *Attorney, Agent, or Firm* — Craig R. Miles; CR Miles, P.C.

(57) ABSTRACT

A weapon sight removably mountable on a weapon provides a plurality of weapon sight segments coupled in end to end linear relation including a front weapon sight segment configured to receive a front sight and a rear weapon sight segment configured to receive a rear sight which disposes the front sight at a fixed distance from the rear sight allowing alignment of the front sight with the rear sight to aim the weapon at a target.

26 Claims, 15 Drawing Sheets

3/6
72
20
21
76
7
83
22
45
59

84
83
73
19
20
7
19
28/29

7
73
13
40
29
29/33
29/32
45
37
18/24
59
64
63
49
3/6

7
73
13
19
18/24
45
49
20
3/6

19
19
41/42
40
43
40
41/42
41/42
44
44
59
49

3/6
7
13
19
20
16
19
28/29
16

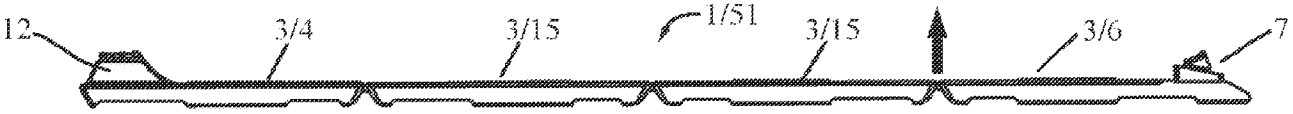
FIG. 47-A
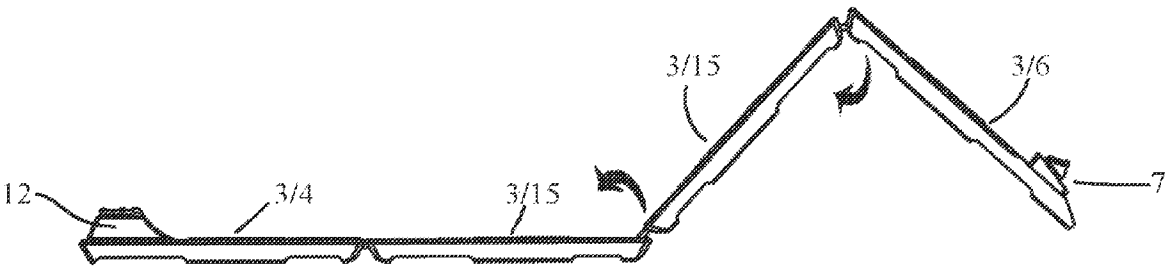
FIG. 47-B
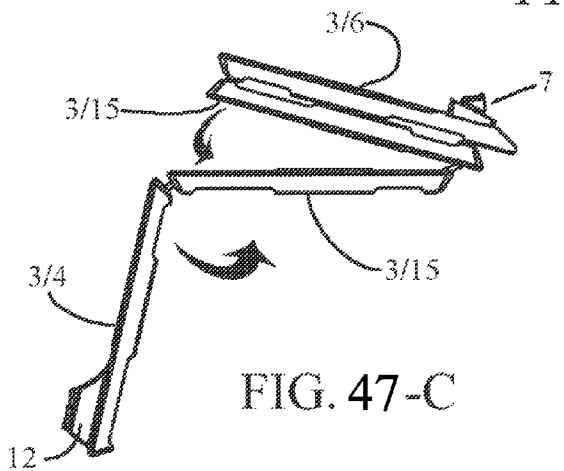
FIG. 47-C
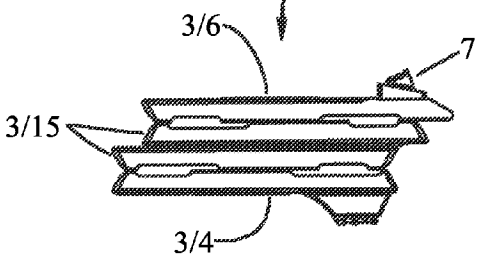
FIG. 47-D

FOLDABLY SEGMENTED WEAPON SIGHT SYSTEM

This United States patent application is a continuation of U.S. patent application Ser. No. 13/134,524, filed Jun. 8, 2013, hereby incorporated by reference herein.

I. FIELD OF THE INVENTION

A weapon sight removably mountable on a weapon provides a plurality of weapon sight segments coupled in end to end linear relation including a front weapon sight segment configured to receive a front sight and a rear weapon sight segment configured to receive a rear sight which disposes the front sight at a fixed distance from the rear sight allowing alignment of the front sight with the rear sight to aim the weapon at a target.

II. BACKGROUND OF THE INVENTION

Conventional weapon sights may only provide a front sight to provide aiming indicia useful in aiming a weapon at moving or flying targets with patterns of shot. Modifications have been made to these weapons over time for use on ground targets at various ranges. These modifications provide an advantage by allowing these weapons to be re-tasked to fire either single projectiles or large caliber shot, or the like. However, this advantage comes with certain disadvantages in regard to the weapon sights.

One substantial disadvantage of the re-tasking of conventional weapons may be that the sights utilized to provide aiming indicia for ground targets sights must be removed to use the weapon for moving or flying targets. Each time the ground target sights are removed and subsequently reinstalled on the weapon, the particulars of the mounting height and distance of the rear sight in relation to the front sight can be minutely changed resulting in an altered point of aim of the weapon. The altered point of aim may require re-adjustment of the rear sight in relation to the front sight and verification of the point of aim. In some cases this requirement for readjustment of the sights and verification of the point of aim prohibits re-tasking of the weapon for different purposes due to the amount of time consumed and noise generated in the process of verifying the point of aim by firing the weapon to compare the point of aim and the actual location of impact of the projectile on a target.

Another substantial disadvantage related to re-tasking conventional weapons may be that attachment of the front sight to the weapon as provided by the manufacturer prohibits re-use upon removal from the weapon. Replacement of the original front sight with another front sight may require a substantial match of the new front sight to the original front sight as to height and width or else other aspects of the weapon may also require modification to re-adjust and verify the point of aim.

Another substantial disadvantage related to re-tasking conventional weapons may be that the addition of a rear sight that works with the original front sight requires a prohibitively short height of the rear sight. Such a short height may preclude substantial elevation adjustment due to constraining geometry. In addition, a short height of the rear sight may hinder proper use of the safety on weapons so equipped due to obstruction with the sight line during disengagement of the safety.

III. SUMMARY OF THE INVENTION

Accordingly, a broad object of the invention can be to provide a weapon sight which can be removably mounted to a weapon to allow the weapon to be re-tasked between a weapon aimed at moving or flying targets and a weapon aimed at ground targets without re-adjustment of the rear sight with front sight and verification of point of aim.

Another broad object of the invention can be to provide a weapon sight having a plurality of weapon sight segments coupled in end to end linear relation, including a front weapon sight segment configured to receive a front sight and a rear weapon sight segment configured to receive a rear sight which in the linear condition of the plurality of weapon sight segments coupled in end to end linear relation disposes the front sight a fixed relation to the rear sight to provide a point of aim which does not require re-adjustment or verification between uses.

Another broad object of the invention can be to provide a weapon sight having a plurality of weapon sight segments coupled in end to end linear relation by a corresponding plurality of coupling elements one or more of which allow rotation of a corresponding one or more weapon sight segments to allow the segmented weapon sight to operate between the linear condition mounted to the weapon and a folded condition upon removal from the weapon.

Another broad object of the invention can be to provide a plurality of weapon sight segments which removably mount to the rail of a weapon. As to particular embodiments each of the plurality of weapon sight segments can provide a segment base disposed between a pair of segment sides which define an open ended channel in which the rail of a weapon can be received to removably mount the weapon sight to the weapon.

Another broad object of the invention can be to provide a mount element coupled to one or more of the plurality of weapon sight segments at a preselected location which acts, upon mounting the weapon sight to the weapon, to position the segmented weapon sight in relation to the weapon allowing the weapon to be aimed without re-adjustment or verification of point of aim of the weapon sight. One aspect of this broad object of the invention can be to provide a plurality of pairs of segment sides having the mount elements at different pre-selected locations, each of which removably couple to one segment body to allow one segmented sight to be used between a plurality of different weapons.

Another broad object of the invention can be to provide a method of using a weapon sight which allows the weapon sight to be operated between the folded condition to the linear condition for removable mounting on a weapon and between the linear condition to the folded condition for storage or transport.

Naturally, further objects of the invention are disclosed throughout other areas of the specification, drawings, photographs, and claims.

IV. BRIEF DESCRIPTION OF THE DRAWINGS

Figure 30:
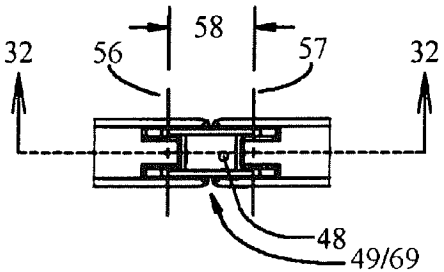
FIG. 30 is an enlarged top plan view shown in FIG. 5 of a pair of adjacent segment ends of a first weapon sight segment and a second weapon sight segment coupled in end to end linear relation by a particular embodiment of a coupling element having a first pivot element and a second pivot element.
Figure 32:
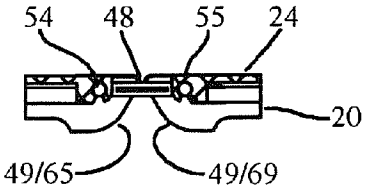

FIG. 32 is a cross section 32-32 shown in FIG. 30 which shows the pair of adjacent segment ends of a first weapon sight segment and a second weapon sight segment coupled in end to end linear relation by a particular embodiment of a coupling element having a first pivot element and a second pivot element correspondingly rotatingly engaged in the first pivot receiving element and the second pivot receiving element.

Figure 33:
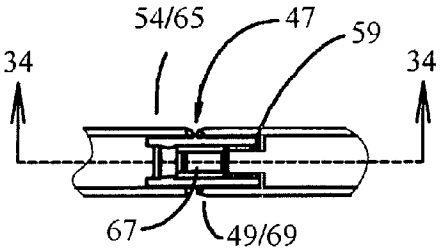

FIG. 33 is a top plan view of a pair of adjacent segment ends of a first weapon sight segment and a second weapon sight segment coupled in end to end linear relation by a second particular embodiment of a coupling element having a first pivot element and a second pivot element.

Figure 34:
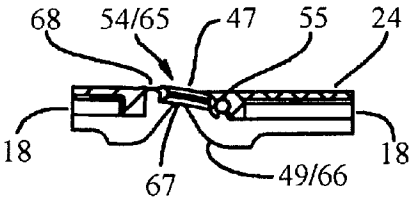

FIG. 34 is a cross section 34-34 shown in FIG. 33 which shows the pair of adjacent segment ends of a first weapon sight segment and a second weapon sight segment coupled in end to end linear relation by the second particular embodiment of the coupling element having a first pivot element and a second pivot element produces as one piece with the first weapon sight segment and the second pivot element correspondingly rotatingly engaged in the a second pivot receiving element produced as one piece of the second weapon sight segment.

Figure 35:
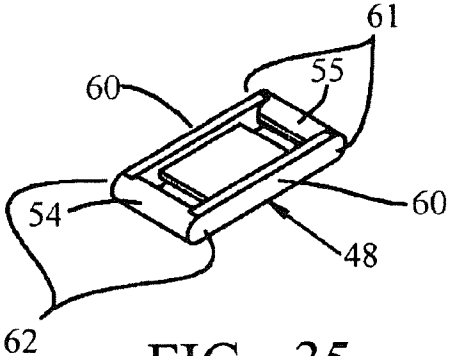

FIG. 35 is a perspective top side view of the particular embodiment of the coupling element shown in FIGS. 30-33.

Figure 36:
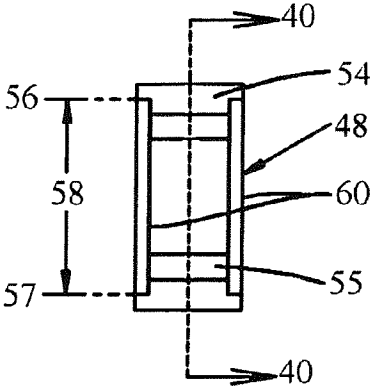

FIG. 36 is a top plan view of the coupling element shown in FIG. 36.

Figure 37:
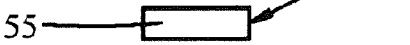

FIG. 37 is an end view of the coupling element shown in FIG. 36.

Figure 38:
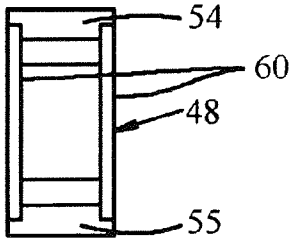

FIG. 38 is a bottom plan view of the coupling element shown in FIG. 36.

Figure 39:
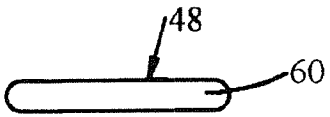

FIG. 39 is a side view of the coupling element shown in FIG. 36.

Figure 40:
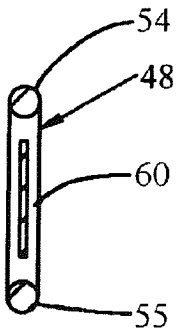

FIG. 40 is a cross section 41-41 of the coupling element shown in FIG. 37.

Figure 41:
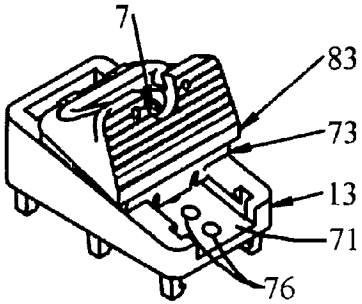

FIG. 41 is a perspective top side view of a particular embodiment of rear sight mount and particular embodiment of a rear sight.

Figure 42:
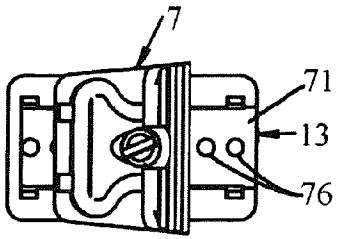

FIG. 42 is a top view of the particular embodiment of the rear sight mount and particular embodiment of the rear sight shown in FIG. 41.

Figure 43:
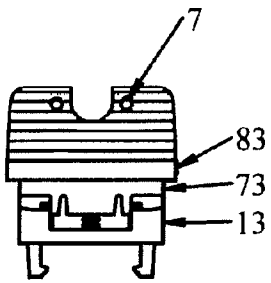

FIG. 43 is a front view of the particular embodiment of the rear sight mount and particular embodiment of the rear sight shown in FIG. 42.

Figure 44:
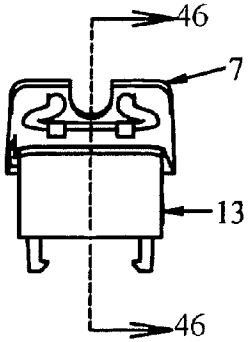

FIG. 44 is a rear view of the particular embodiment of the rear sight mount and particular embodiment of the rear sight shown in FIG. 42.

Figure 45:
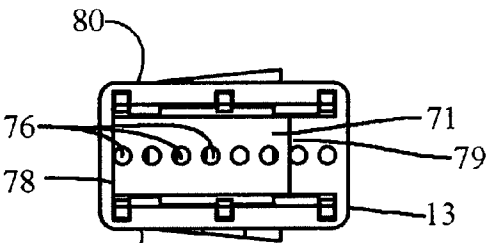

FIG. 45 is a bottom view of the particular embodiment of the rear sight mount and particular embodiment of the rear sight shown in FIG. 42.

Figure 46:
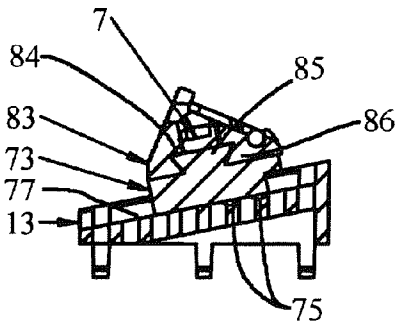

FIG. 46 is the cross section view 46-46 shown in FIG. 44 of the particular embodiment of the rear sight mount and particular embodiment of the rear sight shown in FIG. 42.

FIGS. 47A through 47D provide a stepwise method of folding the linear condition of the inventive weapon sight shown in FIG. 47A to generate the folded condition of the particular embodiment of the inventive weapon sight as shown in FIG. 47D.

V. DETAILED DESCRIPTION OF THE INVENTION

Now referring primarily to FIGS. 1-4, which provide an illustrative overview of the inventive weapon sight (1) and use of the inventive weapon sight (1) to aim a weapon (2). Embodiments of the inventive weapon sight (1) provide a plurality of weapon sight segments (3) coupled in end to end linear relation including a front weapon sight segment (4) configured to receive a front sight (5) and a rear weapon sight segment (6) configured to receive a rear sight (7). Embodiments of the inventive weapon sight (1) can operate between a folded condition (50) (see for example FIGS. 47A through 47D) and a linear condition (51) (see for example FIG. 5) which can be removably mounted to a weapon (2). The plurality of weapon sight segments (3) coupled in end to end linear relation can dispose a mounted front sight (5) a fixed distance (14) from a mounted rear sight (7) which allows the rear sight (7) to be aligned with the front sight (5) to aim the weapon (2).

The term "weapon" as used for the purposes of this invention encompasses any weapon on which embodiments of the inventive weapon sight (1) can be mounted, including as non-limiting examples: shotguns, rifles, handguns, BB guns, pellet guns, cross bows, or the like and in particular includes shotguns having a rail (9) supported a distance above a barrel (10) by spaced engagement of a plurality of posts (11). Between different weapons and in particular different shotguns, the dimensions of the rail (9) and the plurality of posts (11) and the spacing between the plurality of posts (11) can differ. Currently, many different makes and models of shotguns share a similarly dimensioned rail (9) while the spacing between the plurality of posts (11) supporting the rail (9) can differ between weapons (2). The particular weapon (2) including the rail (9) and plurality of posts (11) (typical of shotguns) shown in FIGS. 1-4 is meant to be illustrative of the numerous and varied shotguns or other weapons (2) which include the rail (9) and the plurality of post (11) on which particular embodiments of the inventive weapon sight (1) can be mounted and is not intended to be limiting with respect to the numerous and varied weapons (2) on which other embodiments of the inventive weapon sight (1) can be mounted.

The terms "front sight" and "rear sight" as used for the purposes of this invention encompasses any front sight (5) or rear sight (7) or combination of front sight (5) and rear sight (7) which can be mounted to embodiments of the front weapon sight segment (4) and the rear weapon sight segment (6) and includes, but is not limited to, open or iron sights, night sights, fiber optic sights, or like, and includes without limitation to the forgoing the front sight (5) and front sight mount (12) shown in FIGS. 7 through 13 and the rear sight (7) and rear sight mount (13) shown in FIGS. 14 through 20 and 42 through 47.

Figure 1:
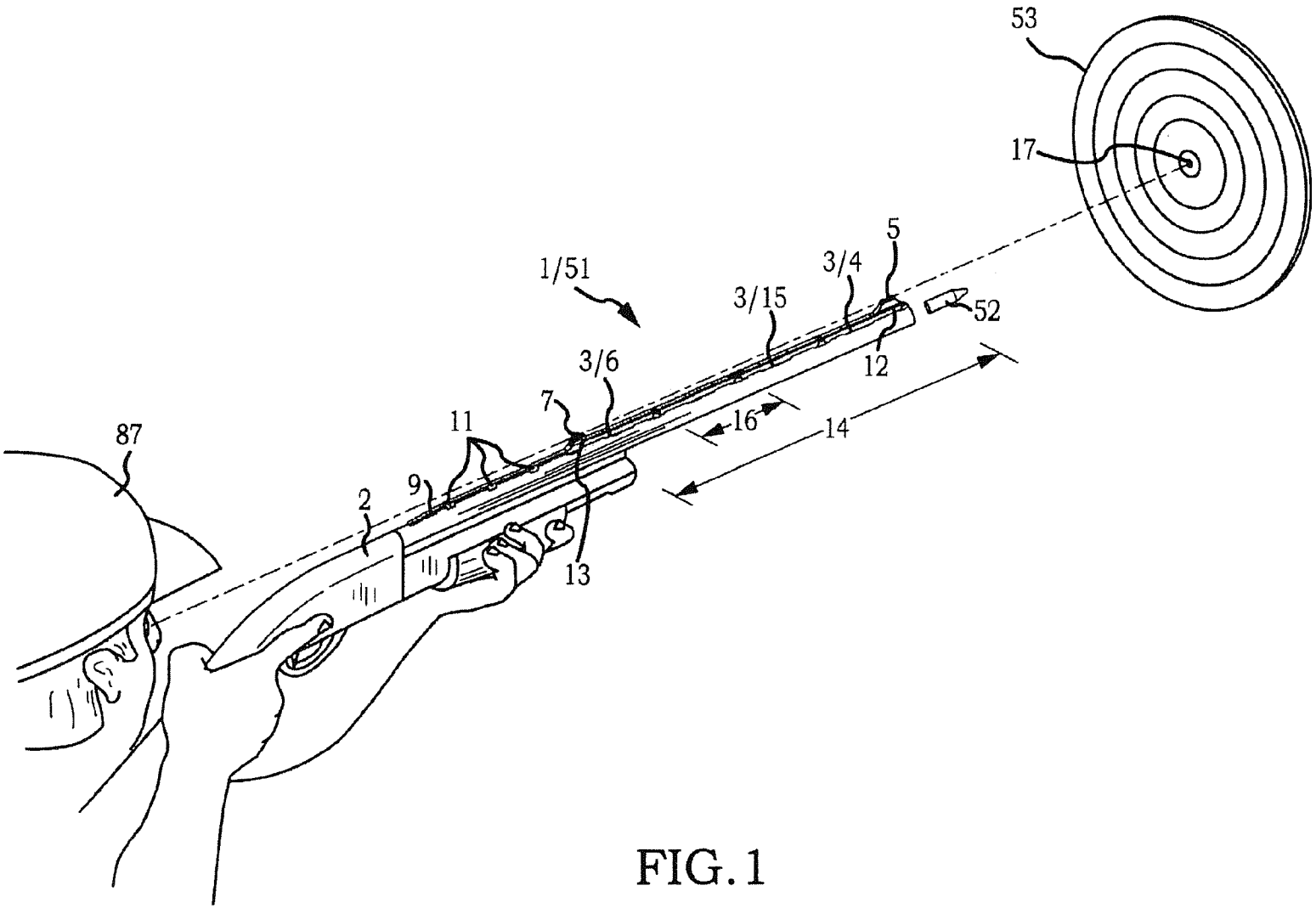
FIG. 1 is an illustration which shows a method of using a particular embodiment of the inventive weapon sight.
Figure 2:
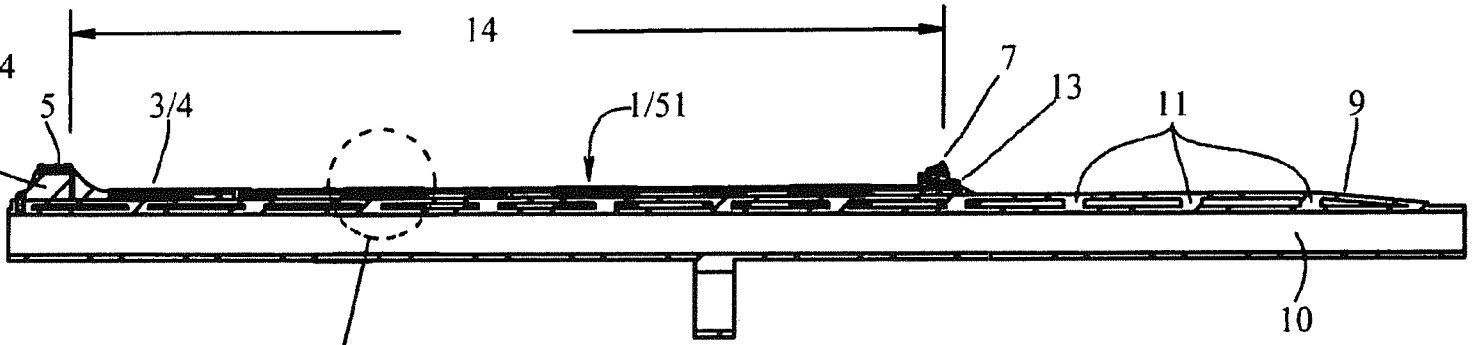
FIG. 2 is a side view of a particular embodiment of the inventive weapon sight mounted to a rail supported by a plurality of posts having spaced engagement on a gun barrel.
Figure 3:
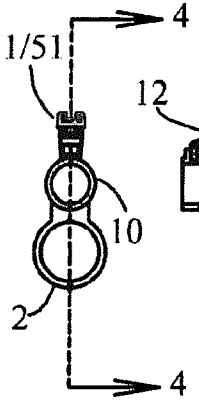
FIG. 3 is a muzzle end view of a particular embodiment of the inventive weapon sight mounted on the rail of the gun barrel shown in FIG. 2.
Figure 4:
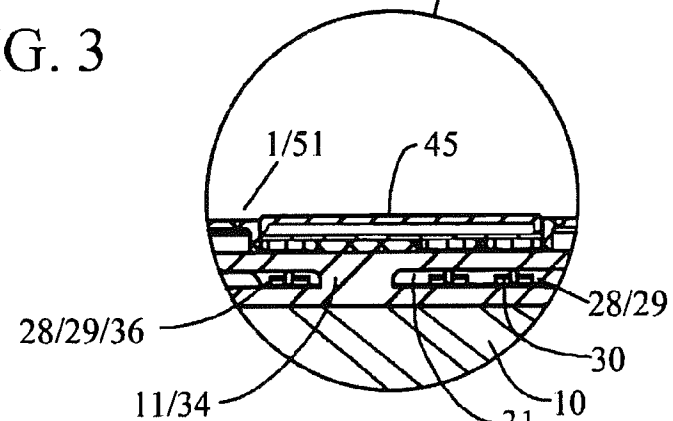
FIG. 4 is a cross section 4-4 shown in FIG. 3 of the particular embodiment of the inventive weapon sight mounted to the rail on the gun barrel shown in FIG. 2.
Figure 5:
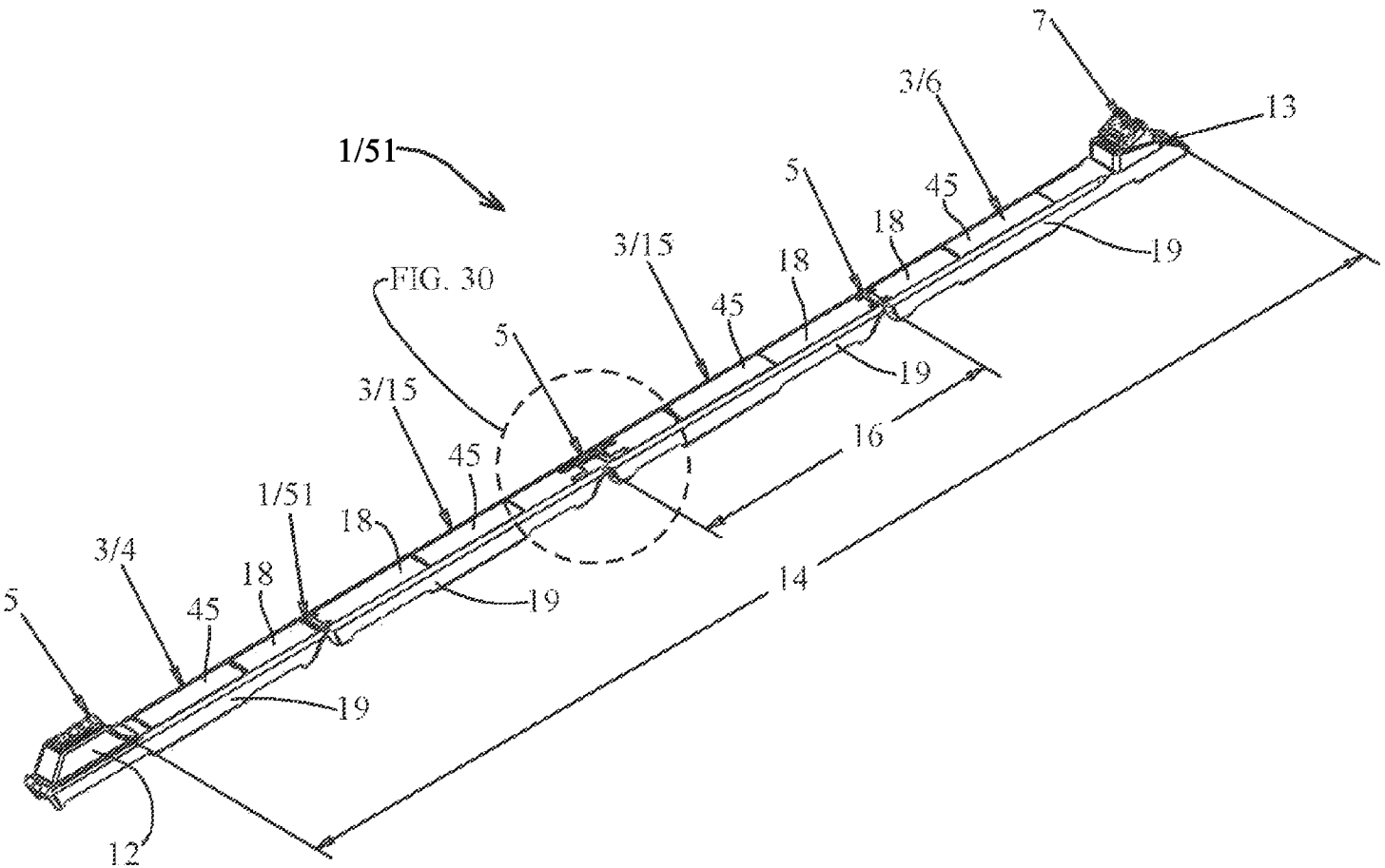
FIG. 5 is a perspective top side view of a particular embodiment of the inventive weapon sight.
Figure 6:
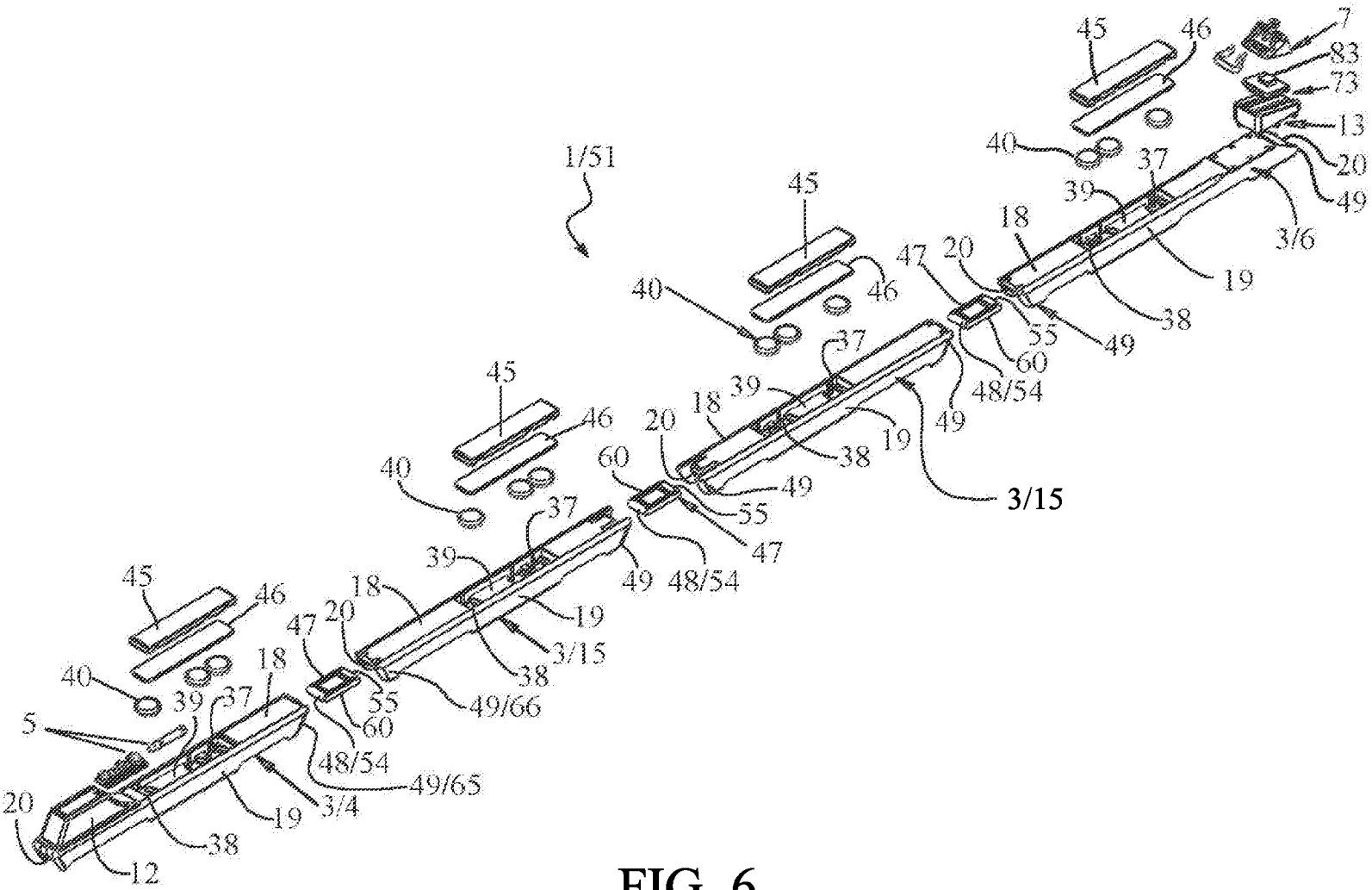
FIG. 6 is an exploded perspective top side view of the particular embodiment of the inventive weapon sight shown in FIG. 5.
Figure 7:
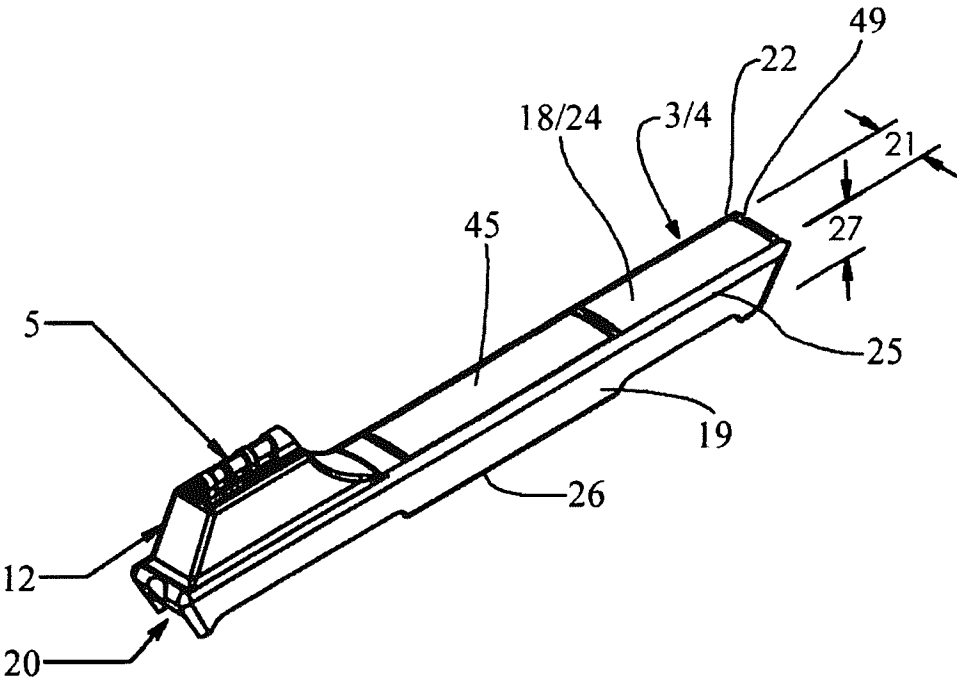
FIG. 7 is a perspective top side view of particular embodiment of a front sight weapon segment.
Figure 8:
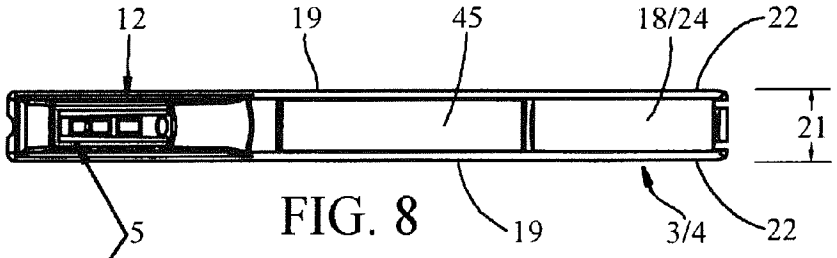
FIG. 8 is a top plan view of the particular embodiment of the front sight weapon segment shown in FIG. 7.
Figure 9:
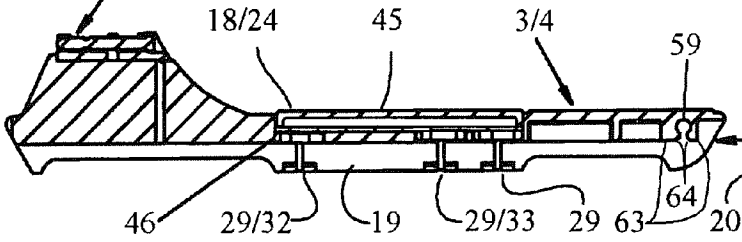
FIG. 9 is a cross section 9-9 shown in FIG. 11 of the particular embodiment of the front sight weapon segment shown in FIG. 7.
Figure 12:
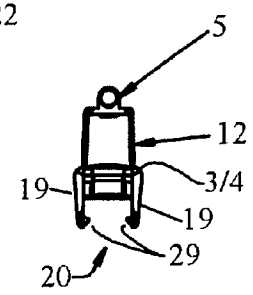
FIG. 12 is a rear end view of the particular embodiment of the front sight weapon segment shown in FIG. 7.
Figure 10:
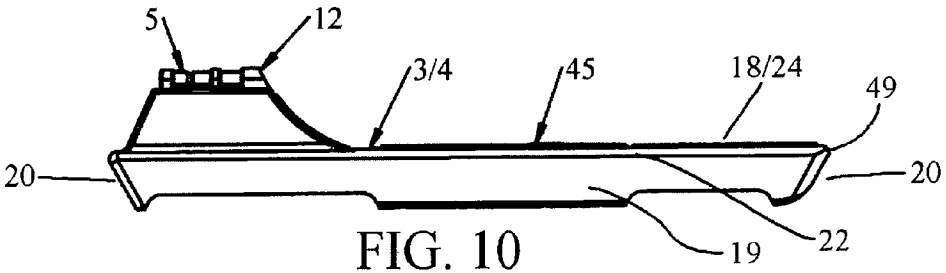
FIG. 10 is a side view of the particular embodiment of the front sight weapon segment shown in FIG. 7.
Figure 13:
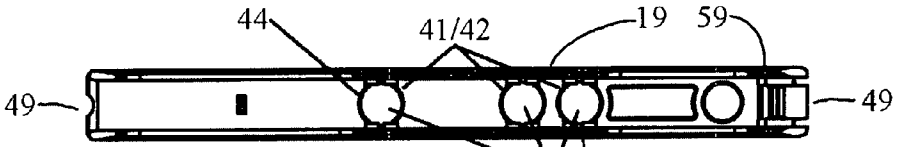
FIG. 13 is a bottom plan view of the particular embodiment of the front sight weapon segment shown in FIG. 7.
Figure 11:
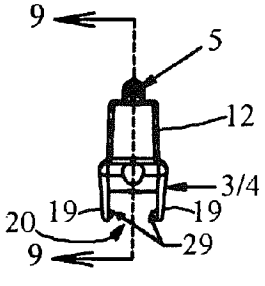
FIG. 11 is a front end view of the particular embodiment of the front sight weapon segment shown in FIG. 7.
Figure 14:
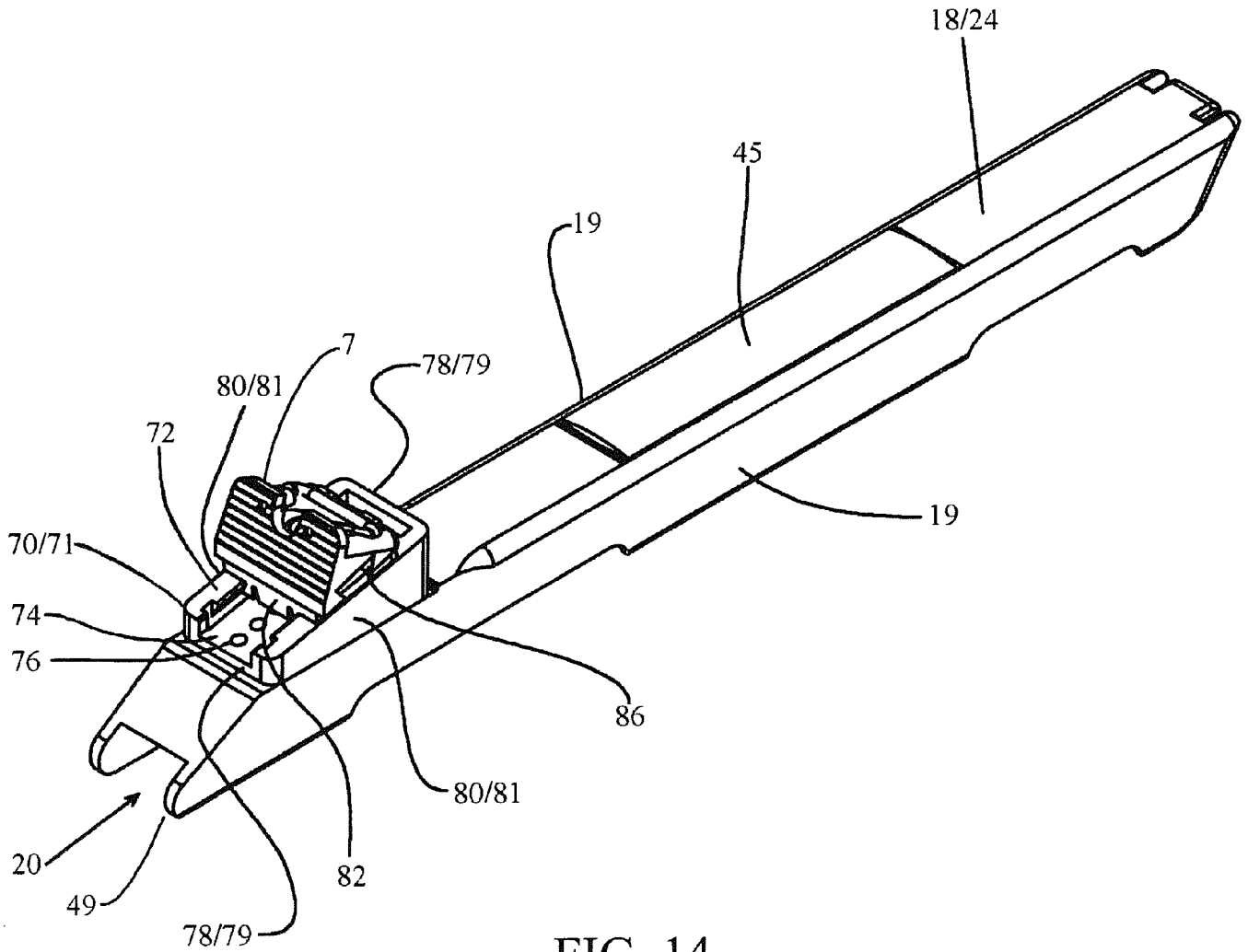
FIG. 14 is a perspective top side view of particular embodiment of a rear sight weapon segment.

Now referring primarily to FIGS. 1 and 6, embodiments of the inventive weapon sight (1) can include a plurality of weapon sight segments (3) coupled in end to end linear relation to dispose the front sight (5) a fixed distance (14) from the rear sight (7). While the particular embodiment shown by FIG. 5 includes a front weapon sight segment (4) configured to receive a front sight (5) and a rear weapon sight segment (6) configured to receive a rear sight (7) and a plurality of intermediate weapon sight segments (15) (the particular embodiment having two intermediate weapon sight segments (15)) disposed between the front weapon sight segment (4) and the rear weapon sight segment (6); the invention is not so limited, and embodiments of the inventive weapon sight (1) can include only a front weapon sight segment (4), or a front weapon sight segment (4) coupled to a rear weapon sight segment (6), or a front weapon sight segment (4) and a rear weapon sight segment (6) having a plurality of intermediate weapon sight segments (15) disposed between the front weapon sight segment (4) and the rear weapon sight segment (6). There is no limit to the number of intermediate weapons sight segments (15) that can be utilized to produce various embodiments of the inventive weapon sight (1).

Accordingly, the plurality of weapon sight segments (3) coupled in end to end linear relation to dispose the front sight (5) a fixed distance (14) from the rear sight (7) can vary in number depending upon the application, the segment length (16) of each of the plurality of weapon sight segments (3) can be provided to establish an overall length of the plurality of weapon sight segments (3) which fixes the distance (14) between the front sight (5) and the rear sight (7) at the fixed distance (14) appropriate to the weapon (2) on which the weapon sight (1) mounts. This constructional form confers an advantage on embodiments of the inventive weapon sight (1) in that the segment length (16) of the plurality of weapon sight segments (3) coupled end to end in linear relation can remain substantially fixed or does not vary between uses. Accordingly, embodiments of the inventive weapon sight (1) can be removably mounted to a weapon (2) without adjustment of to the front sight (5) in relation to the rear sight (7) or verification of the point of aim (17). A related advantage of the inventive weapon sight (1) can be that various embodiments of the weapon sight (1) can be utilized with the same weapon (2) between different applications.

Now referring primarily to FIGS. 7 through 27, embodiments of the front weapon sight segment (4), the rear weapon sight segment (6) and the intermediate weapon sight segment (s) (15) have certain common elements of the constructional form. As to the particular embodiments shown, each of the plurality of weapon sight segments (3) include a segment body (18) disposed between a pair of segment sides (19) which defines within each of the plurality of weapon sight segments (3) an open ended channel (20). The open ended channel (20) can have dimensional relations to receive within the rail (9) of a weapon (2). Understandably, the configuration of the segment body (18) and the pair of segment sides (19) can vary to correspondingly define a configuration of the open ended channel (20) which can receive within a particular configuration of a rail (9) of a weapon (2).

As one non-limiting example, the segment body (18) can be of generally elongate rectangular form having a body width (21) bounded between a pair of body edges (22) disposed in substantially parallel relation and having a thickness disposed between a generally flat top surface (24) and the bottom of the open ended channel (20). The body width (21) of the segment body (18) can fall within a range having end points which encompass the corresponding range of widths in the rails (9) of a corresponding plurality of weapons (2) on which the segment body (18) mounts. As one particular non-limiting embodiment, the body width (21) between the pair of segment sides (19) within the open ended channel (20) can be about 0.3 inch.

Figures 15, 16, 17, 18, 19, 20:
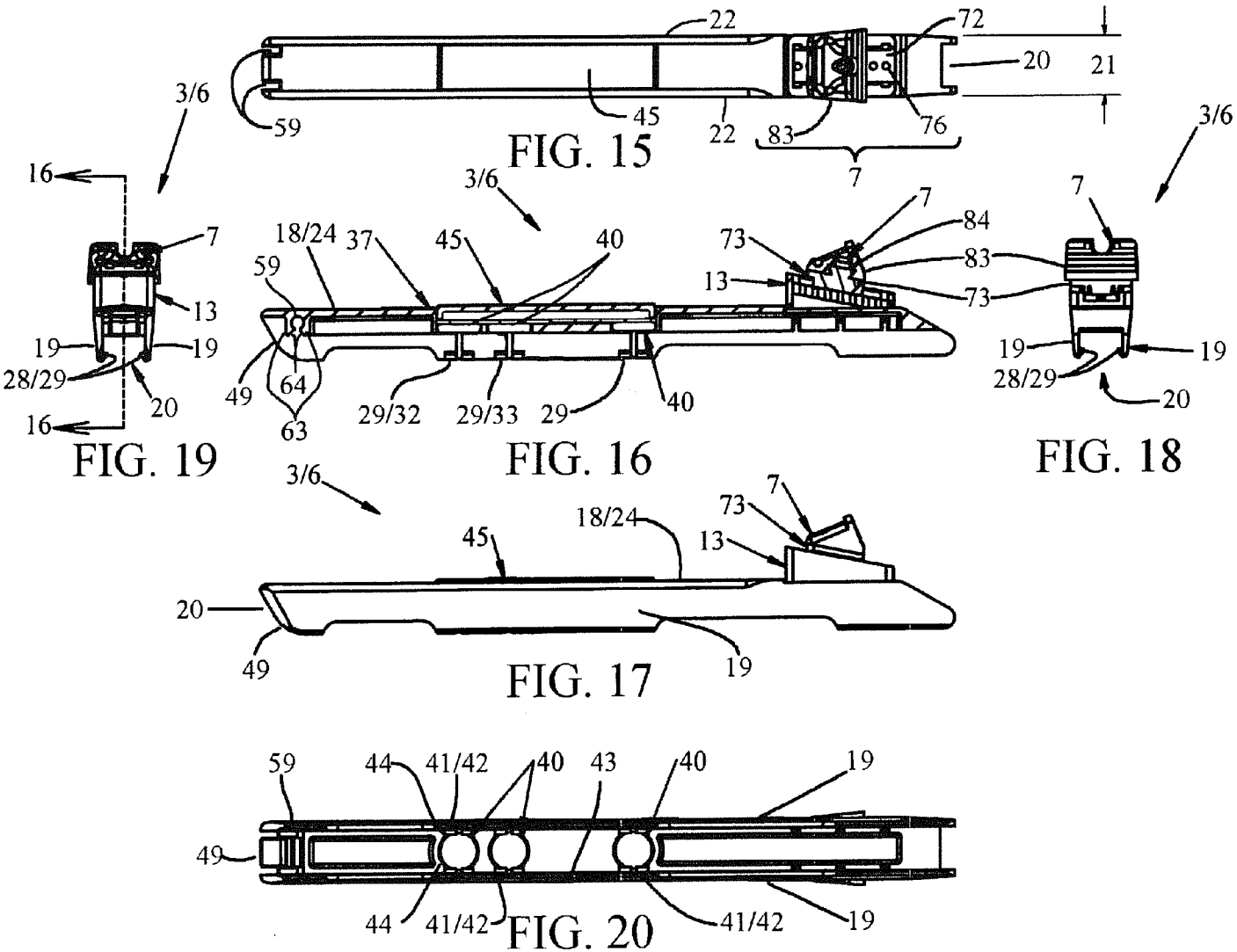
FIG. 15 is a top plan view of the particular embodiment of the rear sight weapon segment shown in FIG. 14.
FIG. 16 is a cross section 16-16 shown in FIG. 19 of the particular embodiment of the rear sight weapon segment shown in FIG. 14.
FIG. 17 is a side view of the particular embodiment of the rear sight weapon segment shown in FIG. 14.
FIG. 18 is a front end view of the particular embodiment of the rear sight weapon segment shown in FIG. 14.
FIG. 19 is a rear end view of the particular embodiment of the rear sight weapon segment shown in FIG. 14.
FIG. 20 is a bottom plan view of the particular embodiment of the rear sight weapon segment shown in FIG. 14.
Figure 21:
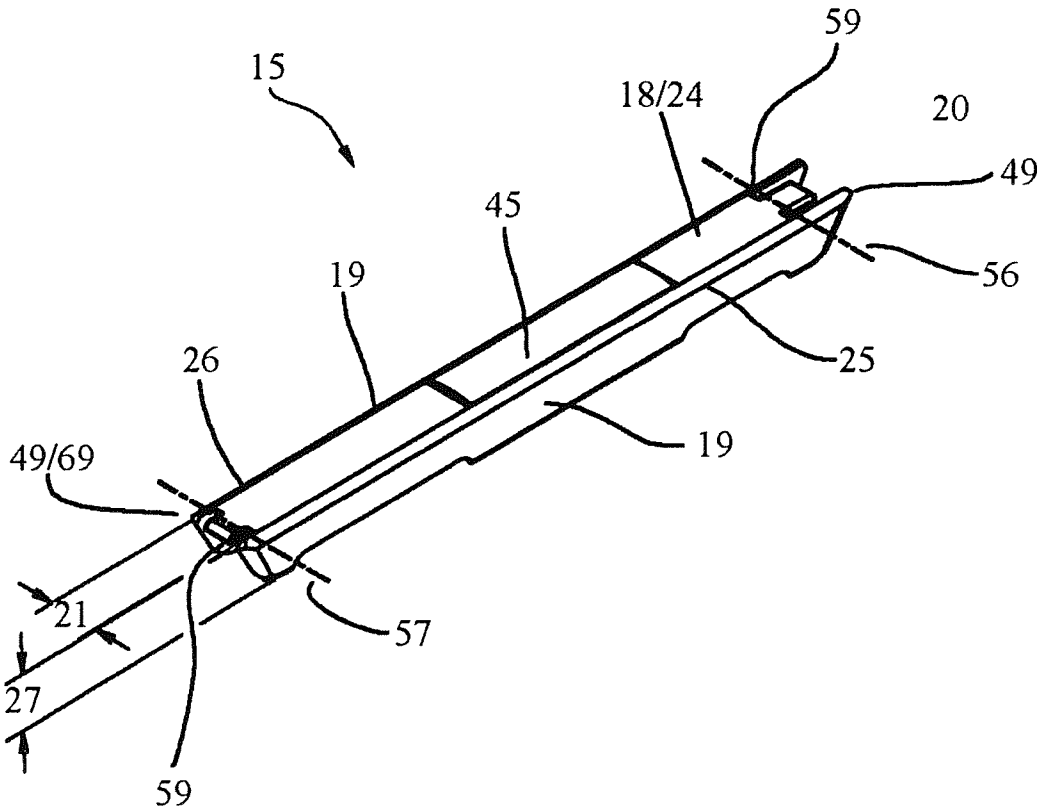
FIG. 21 is a perspective top side view of particular embodiment of an intermediate weapon sight segment.
Figure 22:
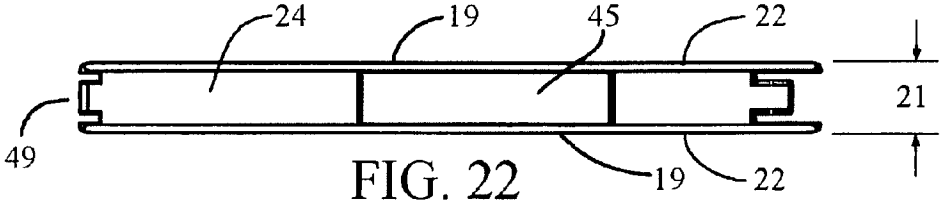
FIG. 22 is a top plan view of the particular embodiment of the intermediate weapon sight segment shown in FIG. 21.
Figure 23:
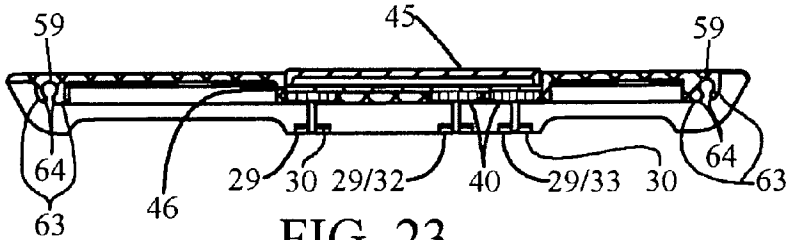
FIG. 23 is a cross section 23-23 shown in FIG. 25 of the particular embodiment of the intermediate weapon sight segment shown in FIG. 21.
Figure 24:
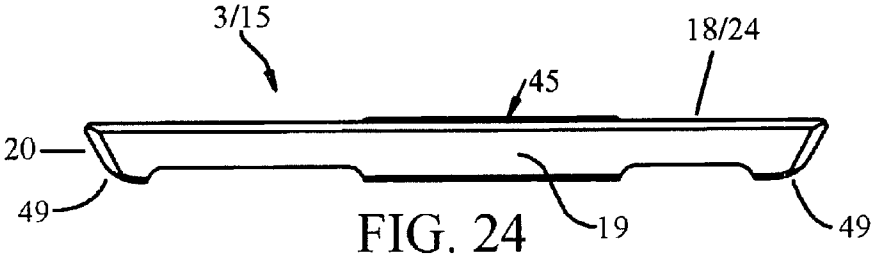
FIG. 24 is a side view of the particular embodiment of the intermediate weapon sight segment shown in FIG. 21.
Figure 27:
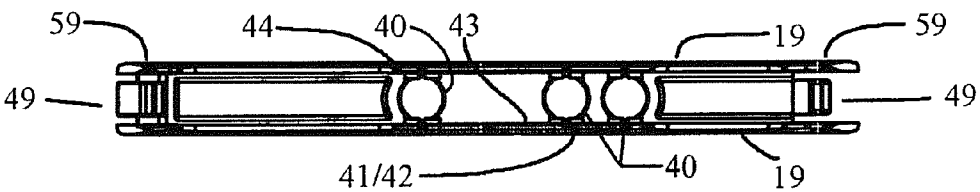
FIG. 27 is a bottom plan view of the particular embodiment of the intermediate weapon sight segment shown in FIG. 21.
Figure 26:
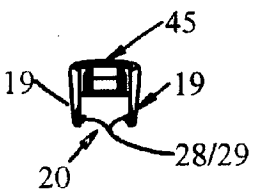
FIG. 26 is a rear end view of the particular embodiment of the intermediate weapon sight segment shown in FIG. 21.
Figure 25:
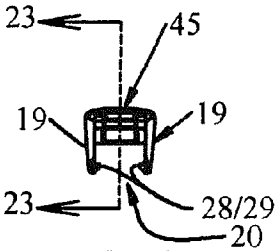
FIG. 25 is a front end view of the particular embodiment of the intermediate weapon sight segment shown in FIG. 21.

Each of the pair of segment sides (19) can be of generally elongate rectangular form having a first side edge (25) which joins a corresponding one of the pair of body edges (22) in generally perpendicular relation as shown for example in FIGS. 18 and 19. As to particular embodiments, the pair of side segments (19) joined to the segment body (18) can each taper inwardly approaching the corresponding second side edge (26). The side segment height (27) of each of the pair of segment sides (19) can fall within a range having end points which encompass the corresponding range of height in the rail (9) of weapon(s) (2) on which the pair of segment sides (19). As one particular non-limiting embodiment, the side segment height (27) can be about 0.35 inches.

Again referring primarily to FIGS. 4 through 29, embodiments of the inventive weapon sight (1) can further include a segment mount (28) coupled to one or more of the plurality of weapon sight segments (3). The segment mount (28) can be configured to allow the plurality of weapon sight segments (3)

to be removably mounted to the rail (9) of a weapon (2). Now referring primarily to FIGS. 10 through 12, 17 through 19, and 24 through 26, one non-limiting example of the segment mount (28) can be in the form of a pair of detents (29) coupled in opposed relation to a pair of segment sides (19) proximate the corresponding second side edge (26). The pair of detents (29) can each provide upward facing inner surface (30) which can engage a corresponding downward facing back surface (31) of the rail (9) of a weapon (2). The distance between the opposed end terminals (32) of each of the pair of detents (29) can be lesser than the width of the rail (9), thereby the inner surface (30) of each of the pair of detents (29) can catchingly engage a corresponding portion of the back surface (31) of the rail (9). As to particular embodiments, the pair of segment sides (19) can have sufficient flexure upon forcible urging of the pair of detents (29) against the rail (9) of the weapon (2) to allow the rail (9) to be slidly received between the pair of detents (29) into the open ended channel (20) allowing the pair of detents (29) to move inwardly to catchingly engage the corresponding back surface (31) of the rail (9) of the weapon (2). The pair of segment sides (19) can be sufficiently flexible to allow release of the pair of detents (29) from catching engagement with the back surface (31) of the rail (9) upon forcible urging of the one or more weapon sight segments (3) away from the rail (9).

Now referring primarily to FIGS. 9 and 10, 16 and 17, and 23 and 24, particular embodiments of the invention can further include the pair of segment sides (19) and corresponding one or more pair(s) of detents (29) configured to matingly engage a particular configuration of spaced engagement of the plurality of posts (11) supporting the rail (9) of a weapon (2). As shown for example in FIGS. 4 and 16, a first pair of detents (29/32) and a second pair of detents (29/33) can be located a distance apart to correspondingly engage the corresponding surfaces of a first post (11/34) and a second post (11/35), thereby conferring the advantage of fixing the position of the associated one of the plurality of weapon sight segments (3) in relation to the rail (9) to reduce or eliminate travel of the weapon sight segment (3) along the rail (9). Additionally, the one or more pair(s) of detents (29) can configured to matingly engage within a particular one of the spaces between posts (11) supporting the rail (9). This configuration allows the particular weapon sight segment (3) to receive the rail (9) within the open ended channel (20) only upon correct placement of the weapon sight segment (3) upon the rail (9). Accordingly, one or more of the pairs of detents (29) can be coupled in opposed relation to the corresponding pair of segment sides (19) at a pre-selected location (36) which affords engagement of the pair of detents (29) with only a particular corresponding post (11) configuration which places the plurality of weapon sight segments (3) in a position on the rail (9) which allows the weapon (2) to be aimed by alignment of the rear sight (7) with said front sight (5).

Figure 28:
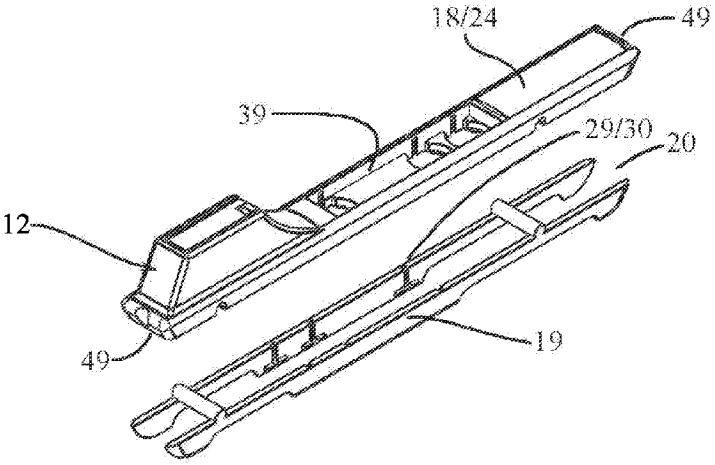
FIG. 28 is a perspective top side exploded view of the particular embodiment of the front weapon sight segment shown in FIG. 7 having a pair of segment sides which removably couple to a segment base.
Figure 29:
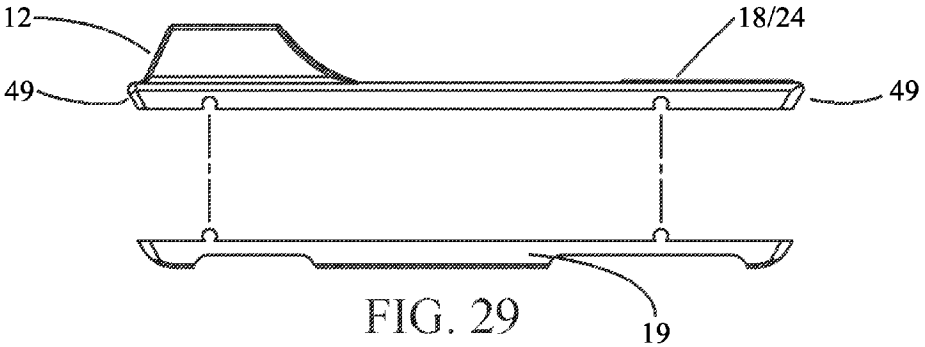
FIG. 29 is a side view of the particular embodiment of the front weapon sight segment shown in FIG. 7 having a pair of segment sides which removably couple to a segment base.

Now referring primarily to FIGS. 28 and 29, which show a particular embodiment of the inventive weapons sight (1) in which the pair of segment sides (19) removably couple the segment body (18). Accordingly, a plurality of pairs of segment sides (19) each having a pre-selected location (36) of the pair(s) of detents each pre-selected location (36) corresponding one of a plurality of different weapons (2). This feature confers the advantage of allowing one particular embodiment of the inventive weapon sight (1) to mount on a plurality of different weapons (2).

Now referring primarily to FIGS. 6, 9, 16, and 23, the segment body (18) can further includes a pass through (37) which defines a pass through aperture (38) which communicates between the top surface (24*a*) of the segment body (18) and the open ended channel (20) defined by the pair of segment sides (19) joined to the segment body (18), as above described. The pass through (37) can be configured to provide a chamber (39) retaining within one or more magnets (40). The magnets (40) can have a location within the pass through (37) which allows magnetically engagement with the rail (9) received within the open ended channel (20). Now referring primarily to FIG. 20, a particular non-limiting embodiment of the pass through (37) can further include a magnet holder (41) which engages one or more magnets (40) to retain the one or more magnets (40) within the chamber (39) of the pass through (37) to position the one or more magnets (40) at a location which allows magnetic engagement with the rail (9). As to the particular embodiment of the pass through (37) shown in the FIG. 20, the magnet holder (41) can provide holder members (42) which project inwardly from opposed side walls (43) of the pass through (37). The holder members (42) terminating in a holder end (44) configured retain one or more circular magnets (40) within the chamber (39) of the pass through (37); however, the invention is not so limited, and the one or more magnets (40) can be of any useful configuration which allows a holder end (44) the magnet holder (41) to retain the one or more magnets (40) within the pass through (37) allowing the one or more magnets (40) to magnetically engage the rail (9). The magnets (40) magnetically engaged to the rail (9) of a weapon (2) can avoid or assist the use of the above described pair(s) of detents (29) to releasably fix the plurality of weapon sight segments (3) in relation to the rail (9) of a weapon (2).

Now referring primarily to FIG. 6, a magnet coupler (46) can be engaged to the one or more magnets (40) to distribute the density of magnetic flux generated by the magnets (40) to magnetically engage a greater or lesser area of the rail (9) or to distribute the density of the magnetic flux more evenly over the rail (9) or other part of the weapon (2) magnetically coupled.

Referring primarily to FIGS. 5 and 6, embodiments of the weapon sight segments (3) can further include a cover (45) configured to removingly engage the perimeter of the pass through (37) to close the area of the pass through aperture (38).

The weapon sight segments (3) can be fabricated or molded from one or more of a wide variety of materials such as plastic, metal, or fiberglass or combinations thereof. The weapon sight segments (3) can be fabricated or molded or fabricated as single piece including the segment body (18) and segment sides (19) or assembled from molded or fabricated from individual components in the form of the segment body (18) and segment sides (19) which may be removably or fixedly joined.

Now referring primarily to FIGS. 5, 6 and 30 through 34, the plurality of weapon sight segments (3) can be coupled in end to end linear relation by engagement of a corresponding plurality of coupling elements (47). Particular embodiments of the coupling element (47) can provide one or more pivot element(s) (48) which allows one or more of the plurality of weapon sight segments (3) to rotate about the one or more pivot element (48) proximate to the corresponding weapon sight segment end (49). As shown in FIG. 33, this affords the advantage of allowing the inventive weapons sight (1) to operate between a folded condition (50) and the linear condition (51). Accordingly, embodiments of the segmented weapon sight (1) which provide one or more coupling elements (47) which include a pivot element (48) can be removed from the rail (9) of weapon (2) and folded by rotation of the plurality of weapon sight segments (3) in relation to one anther to a achieve the folded condition (50) which can be more readily stored or transported. Again, the segmented weapon sight (1) can be unfolded by rotation of the plurality of weapon sight segments (3) in relation to one anther to achieve the linear condition (51) of the weapon sight (1). The segmented weapon sight (1) can be positioned in relation to the rail (9) of a weapon such that forcible urging can locate the rail (9) of the weapon (2) inside of the open ended channel (20). This can as above described locate the front sight (5) and the rear sight (7) in fixed relation a distance apart allowing the weapon (2) to be aimed without re-adjustment of the front sight (5) in relation to the rear sight (7) or verification of the point of aim (17) to the actual impact of the fired projectile (52) with the target (53).

Figure 31:
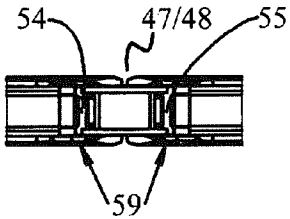
FIG. 31 is bottom plan view of the pair of adjacent segment ends of a first weapon sight segment and a second weapon sight segment coupled in end to end linear relation by a particular embodiment of a coupling element having the first pivot element and the second pivot element correspondingly rotatingly engaged in a first pivot receiving element and a second pivot receiving element.

Now referring primarily to FIGS. 30 through 32, a particular embodiment of the coupling element (47) can provide a first pivot element (54) and a second pivot element (55) having a corresponding first pivot axis (56) and a second pivot axis (57) disposed substantially in fixed parallel relation a distance apart (58). A pair of segment ends (49) as shown for example in FIGS. 30 and 31 can provide a corresponding pair of pivot receiving elements (59) which rotatably couple to a corresponding one of the first pivot element (54) or the second pivot element (55).

Now referring primarily to FIGS. 35 through 40, embodiments of the coupling element (47) having a first pivot element (54) and a second pivot element (55) can further include a pair of pivot links (60) disposed in substantially parallel relation having coupled between, proximate opposed ends (61) (62), the first pivot element (54) and the second pivot element (55). Also referring primarily to FIGS. 31 and 32, the corresponding pair of pivot receiving elements (59) can each further comprise a pair of pivot receiving members (63) extending from the segment body (18) proximate a segment end (49). The pair of pivot receiving members (63) can have opposed surfaces (64) disposed a distance apart and configured to rotatingly receive between one of the first pivot element (54) or the second pivot element (55).

Now referring primarily to FIGS. 33 and 34, another particular embodiment of the plurality of coupling elements (47) can provide a first pivot element (54) in the constructional form of a living hinge (65) coupled to a first segment end (49/66). The living hinge (65) can be in the form of a longitudinal extension (67) of the segment body (18) having a thinned portion (68) which allows the longitudinal extension (67) of the segment body (18) to fold proximate a first segment end (49/66). The longitudinal extension of the segment body (18) can terminate in a second pivot element (55) have the constructional form above described which rotatably couples in a pivot receiving element (59) of a second segment end (49/69), as above described. The examples provided of rotatably coupling a pair of the plurality of weapon sight segments is intended to be illustrative of the numerous and varied constructional forms of the plurality of coupling elements (47) which can be used to allow rotation of the plurality of weapon segments (3) in relation to one another to provide the folded condition (50) of the weapon sight (2).

Now referring primarily to FIGS. 41 through 46, embodiments of the rear weapon sight segment (6) can further include a rear sight mount (13) having a rear sight height adjustment element (70). The rear sight height adjustment element (70) in the form of a ramp (71) having an inclined ramp surface (72) slidingly engaged by a platform (73). A rear sight (7) can be mounted in fixed relation to the platform (73). Travel of the platform (73) on inclined ramp surface (72) allows the height of the platform (73) and the corresponding height of the rear sight (7) to be variably adjusted in relation to the front sight (5).

Certain embodiments of the rear sight height adjustment element (70) can further provide a platform catch (74). One non-limiting example of a platform catch (74) is shown in FIGS. 42, 46 and 47 in which the platform (73) further includes a platform detent (75) located to engage the inclined ramp surface (72). The ramp (71) can further include one or more depressions (76) in the inclined ramp surface (72), such as a hole or a bore. The one or more depressions (76) can be located and have sufficient depth to receive the platform detent (75). As the platform (73) slidingly engages the inclined ramp surface (72), the platform detent (75) can be received within a depression (76) to resist further travel of the platform (73) in relation to the inclined ramp surface (72). Sufficient forcible urging upon the platform (73) can disengage the platform detent (75) from the depression (76) to allow further travel of the platform (73) in relation to the inclined ramp surface (72).

Certain embodiments of the ramp (71) can include an amount of flexure (77) responsive to the platform detent (75) thereby reducing the amount of forcible urging necessary to generate travel of platform detent (75) in relation to the inclined ramp surface (72) and further providing an affirmative engagement of the platform detent (75) in each of the one or more depressions (76). The amount of flexure (77) in the ramp (71) can be generated by fixedly coupling the inclined ramp (71) at each ramp end (78) (79) in the rear sight mount (13) and allowing all or a portion of each ramp side (80) (81) to remain uncoupled to rear sight mount (13) and by selecting appropriate dimensional relations of the ramp (71) in relation to ramp material.

Now referring primarily to FIG. 46, the platform can further include a linear lateral adjustment element (82). The linear lateral adjustment element (82) can be in the form of a stage (83) coupled to the platform (73). The stage (83) can be configured to receive in fixed relation the rear sight (7). The stage (83) can have sliding interlocked engagement with the platform (73) which provides the stage (83) variably adjustable linear lateral location in relation to the front sight (5) by travel of the stage (83) in relation to the platform (73). A particular embodiment of the linear lateral adjustment element (82) can include a dovetail slide (84) in which a dovetail (85) protrudes from the platform (73) and slidly interlocks within a dovetail channel (86) of the stage (83).

Now referring primarily to FIGS. 1-5 and 47A through 47D, the inventive weapon sight (2) can be used by a person (87) by obtaining the weapon sight (2) having a plurality of weapon sight segments (3) coupled in end to end relation in the partially folded or folded condition (50) as shown in any one of FIGS. 47B-47D. By rotating one or more of the plurality of weapon sight segments (3) about one or more a pivot elements (48) as shown in FIGS. 47B and 47C the plurality of weapon sight segments (3) can be established in the linear condition (51) as shown in FIG. 47A. The weapon sight (2) established in the linear condition (51) allows mounting of each of the plurality of weapon sight segments (3) on the rail (9) of a weapon (2) as shown in FIG. 1. The rail (9) of the weapon (2) can be received within an open ended channel (20) of each of said plurality of weapon segments (3) defined by a segment body (18) disposed between pair of segment sides (19), as above described. In receiving the rail (9) within the open ended channel (20) one or magnets (40) can magnetically engage the rail (9) received within said open ended channel (21) in the magnetic flux of one or more magnets retained within a chamber (39) of a pass through (37) of said segment body (18).

Additionally, the person (87) can forcibly urge a pair of detents (29) coupled in opposed relation to said pair of segment sides (19) against the rail (9) to generate sufficient flexure of said pair of segment sides (19) to allow the rail (9) to be slidly received between the pair of detents (29) into the open ended channel (20) allowing said pair of detents (29) to move inwardly to engage a back surface of (31) of the rail (9).

The person (87) by further engaging the pair of detents having a pre-selected location (36) in relation to the pair of segments sides (19) and against a corresponding one of the posts (11) supporting said rail (9) can position the plurality of weapon sight segments (3) in relation to the weapon (2) at a location which allows alignment of said rear sight (7) with said front sight (5) establish a point of aim (17) which does not require re-adjustment or verification between uses of the weapon sight (1) with the weapon (2).

The method of using the weapon sight (1) can further include removing the plurality of weapon sight segments (3) from said rail (9) of the weapon (2). By rotating one or more of the plurality of weapon sight segments (3) about one or more pivot elements (48) as shown in FIGS. 47B through 47C, the weapon sight (1) can be established in the folded condition (50) of the weapon sight (2) as shown in FIG. 47D.

As can be easily understood from the foregoing, the basic concepts of the present invention may be embodied in a variety of ways. The invention involves numerous and varied embodiments of a weapon sight including the best mode of the invention having plurality of weapon sight segments coupled in linear end to end relation and which may be pivotably coupled to allow particular embodiments of the weapon sight to operate between a folded condition and a linear condition in which it can be mounted to a weapon to allow a front sight to be aligned with a rear sight to aim the weapon.

As such, the particular embodiments or elements of the invention disclosed by the description or shown in the figures or tables accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of "sight" should be understood to encompass disclosure of the act of "sighting"—whether explicitly discussed or not—and, conversely, were there effectively disclosure of the act of "sighting", such a disclosure should be understood to encompass disclosure of "sight" and even a "means for sighting." Such alternative terms for each element or step are to be understood to be explicitly included in the description.

In addition, as to each term used it should be understood that unless its utilization in this application is inconsistent with such interpretation, common dictionary definitions should be understood to be included in the description for each term as contained in the Random House Webster's Unabridged Dictionary, second edition, each definition hereby incorporated by reference.

All numeric values herein are assumed to be modified by the term "about", whether or not explicitly indicated. For the purposes of the present invention, ranges may be expressed as from "about" one particular value to "about" another particular value. When such a range is expressed, another embodiment includes from the one particular value to the other particular value. The recitation of numerical ranges by endpoints includes all the numeric values subsumed within that range. A numerical range of one to five includes for example the numeric values 1, 1.5, 2, 2.75, 3, 3.80, 4, 5, and so forth. It will be further understood that the endpoints of each of the ranges are significant both in relation to the other endpoint, and independently of the other endpoint. When a value is expressed as an approximation by use of the antecedent "about," it will be understood that the particular value forms another embodiment. The term "about" generally refers to a range of numeric values that one of skill in the art would consider equivalent to the recited numeric value or having the same function or result.

Moreover, for the purposes of the present invention, the term "a" or "an" entity refers to one or more of that entity unless otherwise limited. As such, the terms "a" or "an", "one or more" and "at least one" can be used interchangeably herein.

Thus, the applicant(s) should be understood to claim at least: i) each of the weapon sights herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification, if any, are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

The claims set forth in this specification, if any, are further intended to describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

We claim:

1. A method of producing a weapon sight, comprising the steps of:

a) providing a plurality of weapon sight segments including:

i) a front weapon sight segment to receive a front sight;

ii) a rear weapon sight segment to receive a rear sight, wherein said plurality of weapon sight segments correspondingly include a plurality of coupling elements which couple said front weapon sight segment to said rear weapon sight segment in end to end linear relation to dispose said front sight a fixed distance from said rear sight, and b) coupling a segment mount to said plurality of weapon sight segments, said segment mount configured to allow said plurality of weapon sight segments to be removably mounted to a rail of a weapon.

2. The method of producing a weapon sight of claim 1, further comprising the step of providing one or more intermediate weapon sight segments which can be coupled between said front sight segment and said rear sight segment in end to end relation to vary said distance between said front sight and said rear sight.

3. The method of producing a weapon sight of claim 1, wherein said step of providing a plurality of weapon sight segments comprises for each of said plurality of weapon sight segments joining a segment body between a pair of segment sides to define an open ended channel which receives within said rail of said weapon.

4. The method of producing a weapon sight of claim 3, further comprising the step of generating a pass through in said segment body which communicates between a top surface of said segment body and said open ended channel, said pass through providing a chamber configured retain within one or more magnets, said magnets located within said chamber to magnetically engage said rail received within said open ended channel.

5. The method of producing a weapon sight of claim 4, further comprising the step of joining a magnet coupler to said one or more magnets to distribute the magnetic flux about said magnet coupler.

6. The method of producing a weapon sight of claim 5, further comprising the step of engaging a cover with said pass through to close said chamber.

7. The method of producing a weapon sight of claim 1, further comprising the steps of:

a) providing a front sight which couples in fixed relation to said front weapon sight segment; and b) providing a rear sight which couples in fixed relation to said rear weapon sight segment.

8. The method of producing a weapon sight of claim 1, further comprising the step of configuring said plurality of coupling elements to further include a pivot element about which one of a pair of said plurality of weapon sight segments rotatably couples proximate a segment end.

9. The method of producing a weapon sight of claim 8, further comprising the steps of configuring each of said plurality of coupling elements to provide a first pivot element and a second pivot element about which a first one of said plurality of weapon sight segments and a second one of said plurality of weapon sight segments correspondingly rotatably couple proximate a corresponding said segment end.

10. The method of producing a weapon sight of claim 9, further comprising the step of coupling a pivot receiving element proximate each said segment end of said first one of said plurality of weapon sight segments and said second one of said plurality of weapon sight segments to correspondingly rotatably engage said first pivot element and said second pivot element.

11. The method of producing a weapon sight of claim 10, further comprising the step of configuring said plurality of coupling elements to allow said plurality of weapon sights to rotate between a folded condition and a linear condition of said weapon sight.

12. The method of producing a weapon sight of claim 1, wherein said step of coupling a segment mount to said plurality of weapons sight segments comprises the step of coupling a pair of detents in opposed relation to a corresponding said pair of segment sides, said pair of segment sides having sufficient flexure upon forcible urging of said pair of detents against said rail of said weapon to allow said rail to be slidly received between said pair of detents into said open ended channel allowing said pair of detents to move inwardly to engage the back side of said rail.

13. The method of producing a weapon sight of claim 12, further comprising the step of coupling said pair of detents in opposed relation to said pair of segment sides of one of said plurality of weapon sight segments at a pre-selected location which upon receiving said rail of said weapon in said open ended channel engages a post supporting said rail of said weapon to place said plurality of weapon sight segments in position on said rail to aim said weapon.

14. The method of producing a weapon sight of claim 13, further comprising the step configuring said pair of segment sides to have sufficient flexure upon forcible urging of said pair of detents against said rail of said weapon to allow said rail to be slidly received between said pair of detents into said open ended channel allowing pair of detents to move inwardly to engage the back side of said rail.

15. The method of producing a weapon sight of claim 14, further comprising the step of providing said pair of segment sides as a plurality of pairs of segment sides each removably joinable to said segment body, each one of said plurality of pairs of segment sides having said pre-selected location of said pair of detents positioned differently to engage a corresponding plurality of different rail configurations, whereby one said weapon sight mounts to a plurality of different weapons.

16. The method of producing a weapon sight of claim 1, further comprising the step of coupling a rear sight mount to said rear sight weapon segment, said rear sight mount having a rear sight height adjustment element which comprises a platform slidably engaged to a ramp, whereby said platform has a height variably adjustable in relation to said front sight by travel of said platform on said ramp.

17. The method of producing a weapon sight of claim 16, further comprising the step of providing a platform catch comprising a platform detent which projects from said platform, said platform detent configured to be received within one or more depressions on said ramp as said platform slides along said ramp.

18. The method of producing a weapon sight of claim 17, further comprising the step of configuring said ramp to sufficiently flex to allow said platform detent upon forcible urging to travel between said one or more depression to adjust height of said platform in relation to said front sight.

19. The method of producing a weapon sight of claim 18, further comprising the step of coupling a linear lateral adjustment element to said platform comprising a stage having a surface configured to receive in fixed relation said rear sight and which provides sliding interlocked engagement with said platform, said stage having linear lateral location variably adjustable in relation to said front sight by travel of said stage in relation to said platform.

20. The method of producing a weapon sight of claim 19, further comprising the step of providing sliding interlocked engagement of said stage with said platform as a dovetail slide in which a dovetail protrudes from said platform and slidely interlocks within a dovetail channel.

21. A method of using a weapon sight, comprising the steps of:

a) obtaining said weapon sight having a plurality of weapon sight segments coupled in end to end relation; and b) rotating one or more of said plurality of weapon sight segments about a pivot to establish said plurality of weapon sight segments in end to end linear relation to dispose a front sight a fixed distance from a rear sight; and c) mounting said plurality of weapon sight segments on a rail of a weapon, said rail received within an open ended channel of each of said plurality of weapon segments, said open ended channel defined by each of said plurality of weapon sight segments by a segment body disposed between pair of segment sides.

22. The method of using a weapon sight of claim 21, further comprising the step of magnetically engaging said rail received within said open ended channel in the magnetic flux of one or more magnets retained within a chamber of a pass through of said segment body.

23. The method of using a weapon sight of claim 22, further comprising the step of forcibly urging a pair of detents coupled in opposed relation to said pair of segment sidewalls against said rail to generate sufficient flexure of said pair of segment side walls to allow said rail to be slidly received between said pair of detents into said open ended channel allowing said pair of detents to move inwardly to engage a back side of said rail.

24. The method of using a weapon sight of claim 23, further comprising the step of engaging said pair of detents against a post supporting said rail to position said plurality of weapon sight segments in relation to said weapon at a location which allows alignment of said rear sight with said front sight to aim said weapon.

25. The method of using a weapon sight of claim 24, further comprising the step of removing said plurality of weapon sight segments from said rail of said weapon.

26. The method of using a weapon sight of claim 25, further comprising the step of rotating one or more of said plurality of weapon sight segments about a pivot to establish a first portion of said plurality of weapon sight segments in folded relation to a second portion of said weapon sight segments.

* * * * *